US010932504B1

(12) United States Patent
Gillam

(10) Patent No.: US 10,932,504 B1
(45) Date of Patent: Mar. 2, 2021

(54) GARMENT MANAGEMENT APPARATUS

(71) Applicant: Tyrus D. Gillam, Maumelle, AR (US)

(72) Inventor: Tyrus D. Gillam, Maumelle, AR (US)

(73) Assignee: Short Kut, Inc., Little Rock, AR (US)

( * ) Notice: Subject to any disclaimer, the term of this patent is extended or adjusted under 35 U.S.C. 154(b) by 385 days.

(21) Appl. No.: 15/401,428

(22) Filed: Jan. 9, 2017

(51) Int. Cl.
*A41D 13/00* (2006.01)
*A41D 1/04* (2006.01)
*A41D 27/20* (2006.01)

(52) U.S. Cl.
CPC ..... *A41D 13/0012* (2013.01); *A41D 1/04* (2013.01); *A41D 27/20* (2013.01); *A41D 2600/20* (2013.01)

(58) Field of Classification Search
CPC ..... A41D 1/04; A41D 13/12; A41D 13/0012; A41D 27/08; A41D 27/205; A41D 27/02; A47F 7/02; A47F 7/146; G09D 3/02
USPC .. 2/94, 102, 48, 20, 51, 253, 247, 249, 250, 2/251, 252; 434/430; 224/185, 223, 650, 224/652, 684, 674
See application file for complete search history.

(56) References Cited

U.S. PATENT DOCUMENTS 770,354 A * 9/1904 Corfman ..... A45C 3/00 223/108
1,962,687 A * 6/1934 Hodge ..... G09B 21/00 434/112
1,979,879 A * 11/1934 Harris ..... A41D 13/04 2/48
2,066,072 A * 12/1936 Powell ..... A41D 13/0012 2/51
2,767,895 A * 10/1956 Smith ..... B60R 7/043 224/275
3,055,133 A * 9/1962 Anderson ..... A41D 1/04 2/102
3,529,307 A * 9/1970 Belson ..... A41D 13/0012 2/94
3,749,233 A * 7/1973 McCormick, Jr. ..... A45C 11/26 206/373
D257,596 S * 12/1980 Rosenbloom, III ..... D2/864
D263,006 S * 2/1982 Boker ..... D2/829
D268,624 S * 4/1983 Taylor ..... D2/829
4,637,075 A * 1/1987 Ingrisano ..... A41D 13/0012 2/102
4,736,853 A * 4/1988 O'Mara ..... A45C 11/00 206/224
4,859,084 A * 8/1989 Kaumeyer ..... A45C 3/00 383/39
4,876,724 A * 10/1989 Suzuki ..... H04R 5/023 381/385
D305,825 S * 2/1990 Tenore ..... D2/829
4,901,899 A * 2/1990 Barrett ..... A01K 97/06 206/315.11
4,949,843 A * 8/1990 Stokes ..... A45C 7/0095 206/305

(Continued)

*Primary Examiner* — Jillian K Pierorazio
(74) *Attorney, Agent, or Firm* — Rashauna Norment

(57) ABSTRACT

A garment, namely, a vest, may be worn by a barber or hair stylist for easily identifying, accessing, and storing multiple hair cutting tools, implements, and accessories. The vest has a plurality of retaining members, a means for adjusting the fit of the vest about the shoulders, chest, and waist, and an attachment assembly for removably attaching and coupling the vest to a backpack. The vest provides the barber with flexibility and mobility when giving someone else a haircut or a trim, or when engaging in other activities.

9 Claims, 10 Drawing Sheets

(56) References Cited

U.S. PATENT DOCUMENTS

D316,107 S * 4/1991 Lockner ..... 402/79
5,014,359 A * 5/1991 Hanson ..... A41D 13/0012 2/102
5,050,747 A * 9/1991 Krautsack ..... A47F 7/14 211/50
D325,487 S * 4/1992 Giseburt ..... D3/201
5,188,229 A * 2/1993 Bernstein ..... G11B 33/0427 206/308.1
5,265,782 A * 11/1993 McNamara ..... A41D 13/12 2/108
5,278,998 A * 1/1994 Book ..... A41D 13/0012 190/1
5,361,412 A * 11/1994 Perry ..... A41D 13/0012 2/102
D381,190 S * 7/1997 Deon ..... D2/861
D390,053 S * 2/1998 Waters ..... D19/86
6,189,149 B1 * 2/2001 Allen ..... A41D 13/0055 2/102
6,233,739 B1 * 5/2001 Spence ..... A41D 13/0012 2/94
6,241,086 B1 * 6/2001 Bergh ..... B42F 7/025 206/232
6,267,277 B1 * 7/2001 Taylor ..... A45C 7/0095 206/350
6,669,608 B1 * 12/2003 Winston ..... A63B 21/065 2/102
6,763,527 B1 * 7/2004 Rivoli ..... A41D 13/0012 2/250
D522,719 S * 6/2006 Sanders ..... D2/857
D544,542 S * 6/2007 Carson ..... D19/59
D622,036 S * 8/2010 Mason, III ..... D2/829
D641,551 S * 7/2011 Deinert ..... D3/247
D661,839 S * 6/2012 Isaacs ..... D29/101.4
8,209,772 B2 * 7/2012 Curry ..... A41D 13/04 2/247
D683,933 S * 6/2013 Robbins ..... D2/829
8,719,966 B2 * 5/2014 Grozdev ..... A41D 13/0012 2/247
8,727,409 B2 5/2014 McCambridge
8,875,314 B1 * 11/2014 Panetta ..... A41D 13/0012 2/102
8,910,315 B1 12/2014 Stephens
2003/0056374 A1 * 3/2003 Langley ..... B26B 19/20 30/200
2003/0089749 A1 * 5/2003 Valdez-Campbell ..... A45C 7/0095 224/153
2004/0007544 A1 * 1/2004 MacKelvie ..... G11B 33/0422 211/40
2006/0011690 A1 * 1/2006 Bareno ..... A45F 3/14 224/638
2006/0288466 A1 * 12/2006 Bucheit ..... A41D 13/0012 2/102
2008/0301863 A1 * 12/2008 Goff ..... A41D 13/0012 2/467
2009/0151040 A1 * 6/2009 Lee-Johnson ..... A41D 13/0012 2/51
2009/0255134 A1 * 10/2009 Boutin ..... B25H 3/003 30/329
2012/0125957 A1 * 5/2012 Barber ..... A45F 3/46 224/242
2012/0291179 A1 * 11/2012 Shea ..... A41D 27/20 2/102
2013/0167286 A1 7/2013 Hudson
2014/0054195 A1 * 2/2014 Hallman ..... A45C 11/008 206/581

* cited by examiner

GARMENT MANAGEMENT APPARATUS

CROSS-REFERENCE TO RELATED APPLICATIONS

Not applicable.

FEDERALLY SPONSORED RESEARCH AND DEVELOPMENT

Not applicable.

BACKGROUND OF THE INVENTION

1. Field of the Invention

The invention generally relates to a garment management apparatus having a garment, a plurality of retaining members located on the garment, a means for adjusting the fit of the garment on the user, and an attachment assembly for removably attaching a backpack to the garment. More particularly, the invention relates to a vest worn by a barber for storing hair cutting tools and styling tools, implements, accessories, and equipment in a manner that is easily accessible and convenient when giving a haircut.

2. Description of Arguably Related Art Including Information Disclosed for 37 CFR 1.97 and 1.98

When providing someone with a haircut, a trim, other hair styling or grooming option (collectively, "a haircut"), a hair stylist, a barber, or any other person (collectively, a "barber") may use a hair cutting device to perform the haircut. The hair cutting device, for example, electric hair clippers, may have a plurality of removable attachment guide combs or guards each varying in size, a stationary blade, and a moving blade. During the haircut, the barber may also use a pair of scissors or shears, a styling comb, a brush, a mirror, and other various implements and accessories. A barber often has limited space during performance of the haircut, for example, the barber may have only a small countertop or area to arrange and place the various tools and implements to be used during the haircut. The lack of ready access and organization decreases the barber's efficiency.

Some storage options exist for storing and arranging the tools, accessories, and implements (collectively, "implements") for use with hair cutting devices, but those storage options must be placed either on a table top, a stand, hung on a wall, or placed on the floor. Each of these storage options impede the barber's flexibility and mobility to move around the subject while still having easy access and organization of the implements.

The barber may use one of many different sized attachment combs or guards throughout the haircut. Without an effective storage management apparatus, the barber may need to rummage through the multiple implements to locate and swap to a different implement as he frequently returns to the storage station before returning to the subject. This movement is time consuming and inefficient. Even if an organization device is next to the barber, the barber still has to reach beyond his personal space or walk away from the subject to retrieve the desired tool.

U.S. Pat. No. 8,910,315 issued to Stephens discloses a garment, namely, a vest, for carrying items. The vest includes a left breast panel, a right breast panel, hooks and loops and other fasteners for stabilizing the vest, swivel hoops and hooks on the breast panel, and a pouch located at the lower portion of the vest. U.S. Patent Application Publication No. 2013/0167286 filed by Hudson discloses a vest having a plurality of see-through removable pockets. U.S. Pat. No. 5,975,290 issued to Lowe discloses a protective holder for hair cutting accessories for protecting blades and guards of hair clippers. This protective holder has inner and outer panels each in a generally rectangular configuration, with each panel having four pockets with horizontally oriented slotted openings for receiving hair cutting accessories within the pockets.

None of the references disclose, teach, or suggest an improved garment management apparatus that allows the barber to comfortably wear a garment or vest while providing organized, efficient access to the implements needed to perform the haircut.

A need exists for an improved garment management apparatus that has a garment, a plurality of retaining members, with each of the retaining members varying in size and shape, a means for adjusting the fit of the garment on the user, and an attachment assembly for removably coupling a backpack to the garment.

A need exists for an improved garment management apparatus that is inexpensive to manufacture, and that is lightweight, durable, and comfortable for the user.

A need exists for an improved garment management apparatus that has customized retaining members for removably retaining attachment guide combs or guards, hair cutting blades, and other implements, tools, and equipment used when a barber gives a haircut, trim, or other hair styling or grooming method.

A need exists for an improved garment management apparatus that allows a user to readily identify and efficiently access implements that are inserted into the retaining members without the user needing to move beyond his personal space to a separate storage or management station.

SUMMARY OF THE INVENTION

The invention is essentially a garment management apparatus worn by a barber, a hair stylist, or any other person (collectively: a "barber") so that the barber can easily identify, access, and store hair cutting tools, implements, and accessories (collectively, "implements") without reaching beyond his personal space. The garment may be worn by a barber who is giving someone else a haircut, or by a person giving himself or herself a haircut or a trim. The barber may also wear the garment even if he is not about to immediately perform a haircut. For example, the barber may wear the garment to display the implements when not in use or when simply conducting business or life activities throughout the day. The garment may be slipped over the head, or the garment may have two front panels that open and close with a fastener. The present invention may be useful with any hair cutting device that employs removable attachment guide combs or guards. Use of the invention for holding barber or hair styling tools, equipment, and/or accessories is preferred, although other non-barbering tools, equipment, implements, and/or accessories may be retained within the retaining members.

In one embodiment, the garment management apparatus is a garment that comprises (includes or has) an assembly or a plurality of retaining members, each of the retaining members positioned on or attached to the garment, with at least one of the plurality of retaining members having a different size and shape from the other retaining members; a means for adjusting the fit of the garment; and an attachment assembly positioned on or at the back of the garment for removably coupling or attaching a backpack or other compartment to the garment. The plurality of retaining members may include sleeve members, pouches, open slot members, open holders, and pockets for holding various implements used in cutting and styling hair.

In another embodiment, the garment is essentially a vest that has a front panel, two side panels, and a back panel. The vest comprises a plurality of sleeve members positioned and space apart in a plurality of rows and columns along the front panel of the vest, with each of the sleeve members having a front, a tab, and a cutout defined in the front of the sleeve member; at least one pouch having a fastener, a holder; at least two pockets; a plurality of slot members, with each of the slot members being arranged on the front panel and side panels of the vest; two adjustable shoulder support members and two adjustable side strap members, each for adjusting the fit of the vest on the user; and an attachment assembly for removably attaching the vest to a backpack or other compartment.

It is an object of the invention to provide an improved garment management apparatus that has a plurality of retaining members, with each of the retaining members varying in size and shape, a means for adjusting the fit of the garment on the user, and an attachment assembly for removably coupling a backpack to the back of the garment.

It is an object of the invention to provide an improved garment management apparatus that is inexpensive to manufacture, and that is lightweight, durable, and comfortable for the user.

It is an object of the invention to provide an improved garment management apparatus that has customized retaining members for removably retaining various attachment guide combs or guards, hair cutting blades, and other implements, tools, and equipment used when a barber gives a haircut.

It is yet another object of the invention to provide an improved garment management apparatus that allows a user to readily identify and efficiently access implements that are inserted into one of the plurality of retaining members on the garment without the user needing to move to a separate storage or management station beyond his personal space.

It is an object of the invention to provide an improved garment management apparatus that has adjustable shoulder support members and side strap members for the wearer's comfort.

It is an object of the invention to provide an improved garment management apparatus that keeps hair cutting implements secure and easily accessible to the barber while allowing a barber to move around a subject at will.

These and other aspects, objects, embodiments, and advantages of the invention will become apparent from the accompanying drawing and the following detailed description of the preferred embodiments of the invention.

BRIEF DESCRIPTION OF THE SEVERAL VIEWS OF THE DRAWING

The invention may be more readily described by reference to the accompanying drawing figures and the following description of the drawing figures. The reference numbers apply to each embodiment of the invention. In the drawing.

Figure 1:
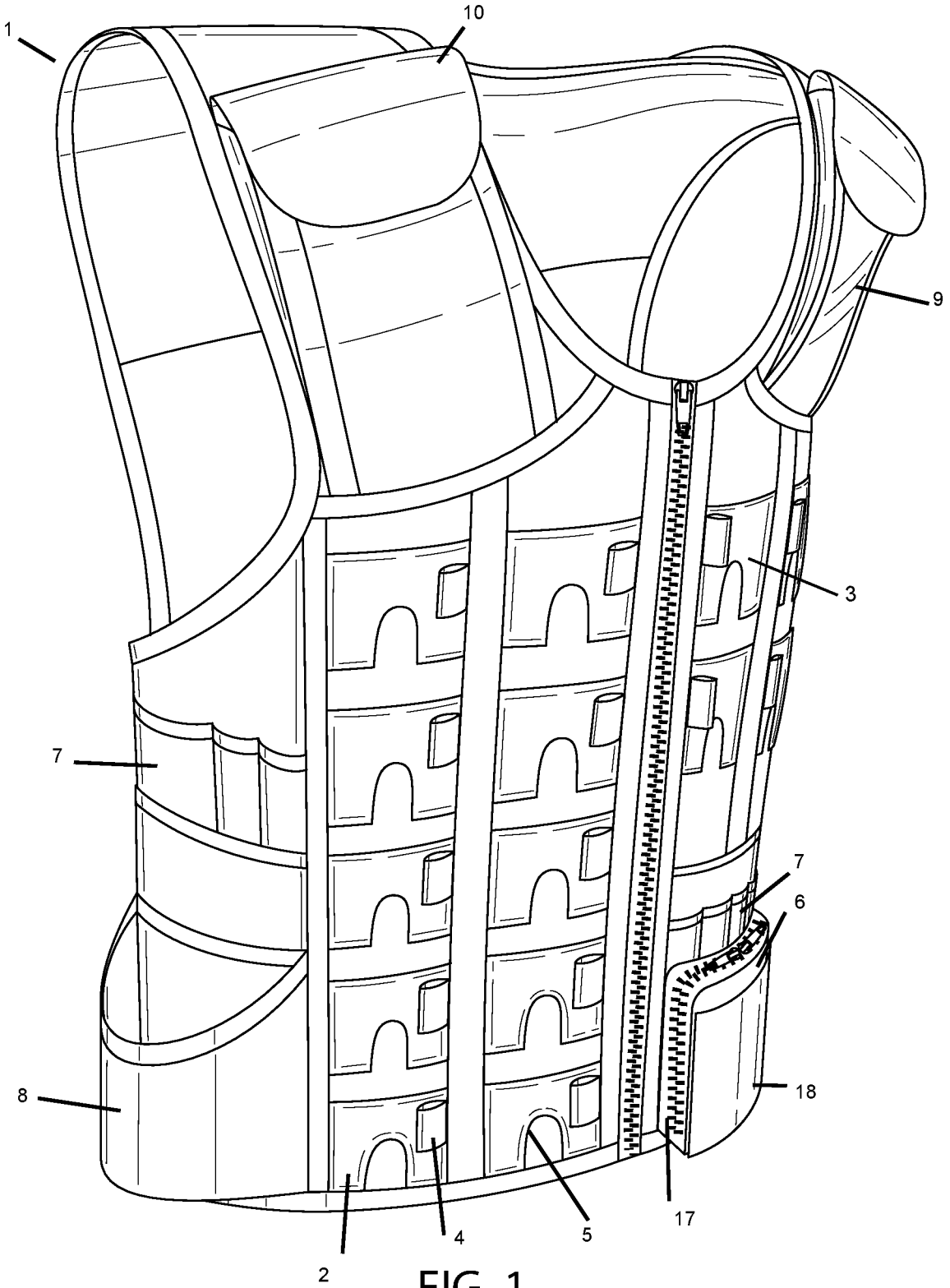
FIG. 1 is a perspective view of an improved garment management apparatus.
Figure 2:
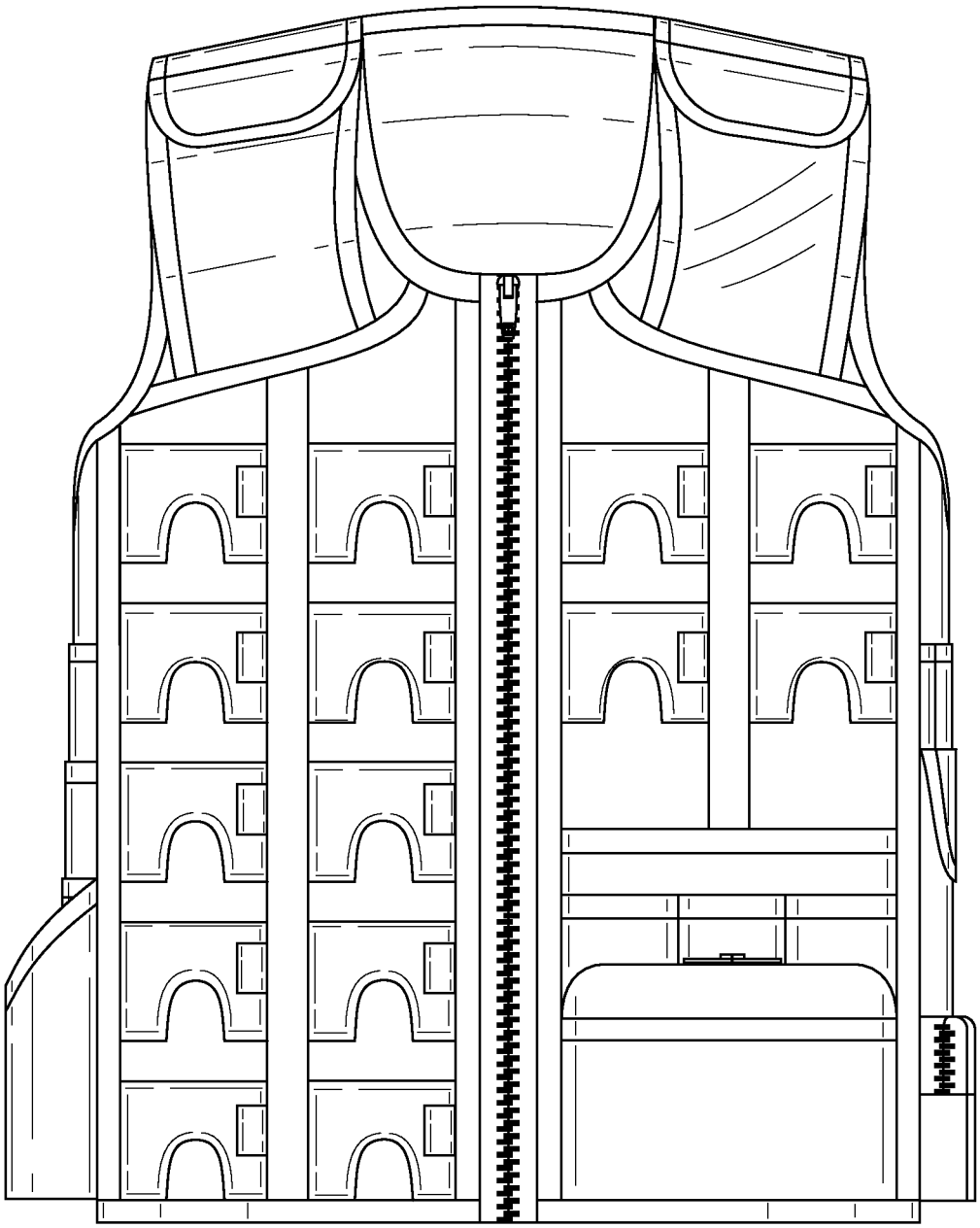
FIG. 2 is a front plan elevation view of FIG. 1 thereof.
Figure 3:
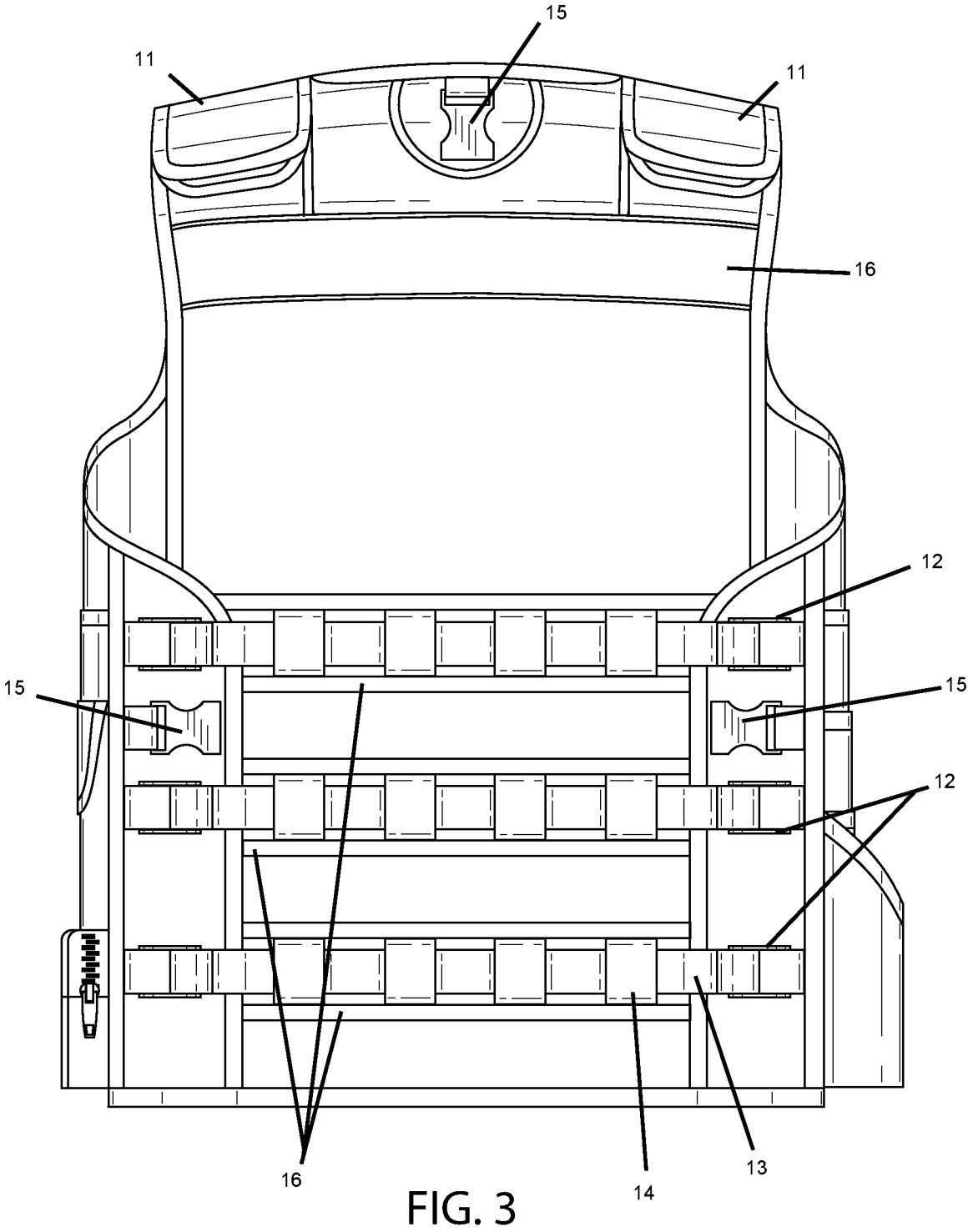
FIG. 3 is a rear plan elevation view of FIG. 1 thereof.
Figure 4:
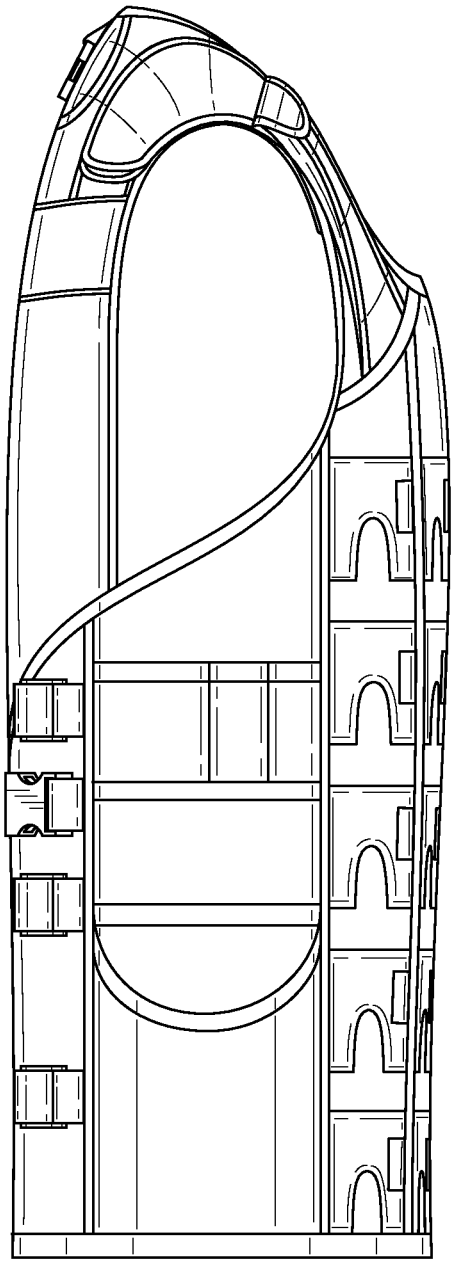
Figure 5:
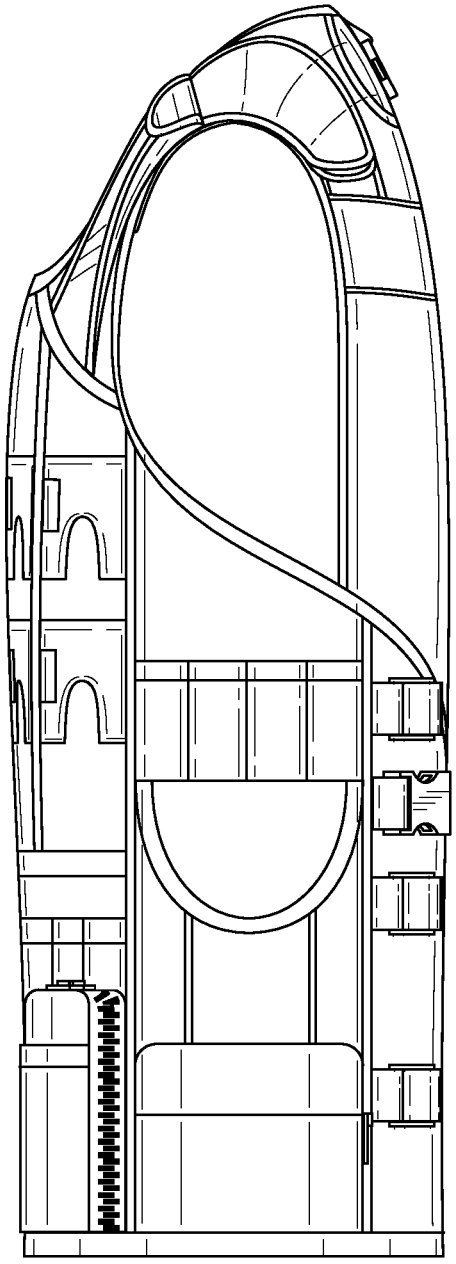
Figure 6:
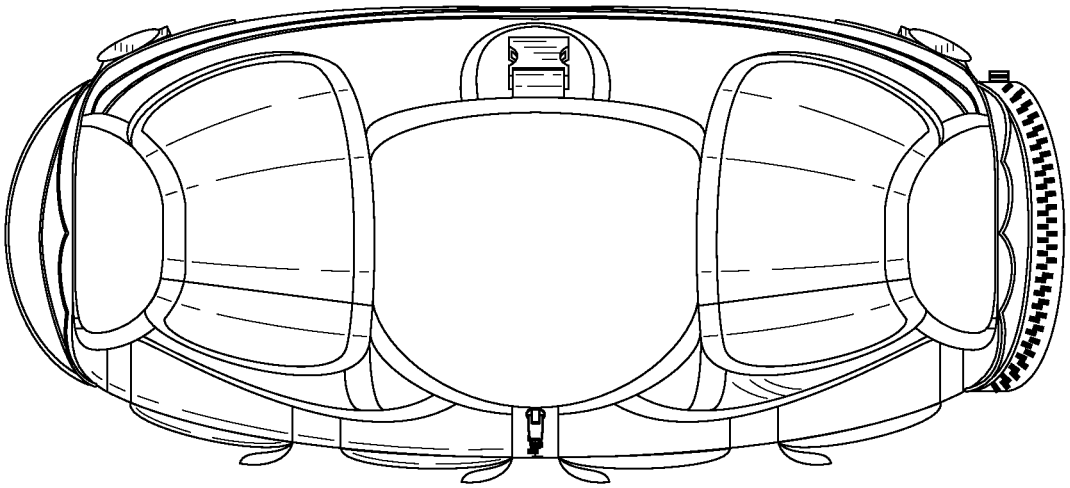
Figure 7:
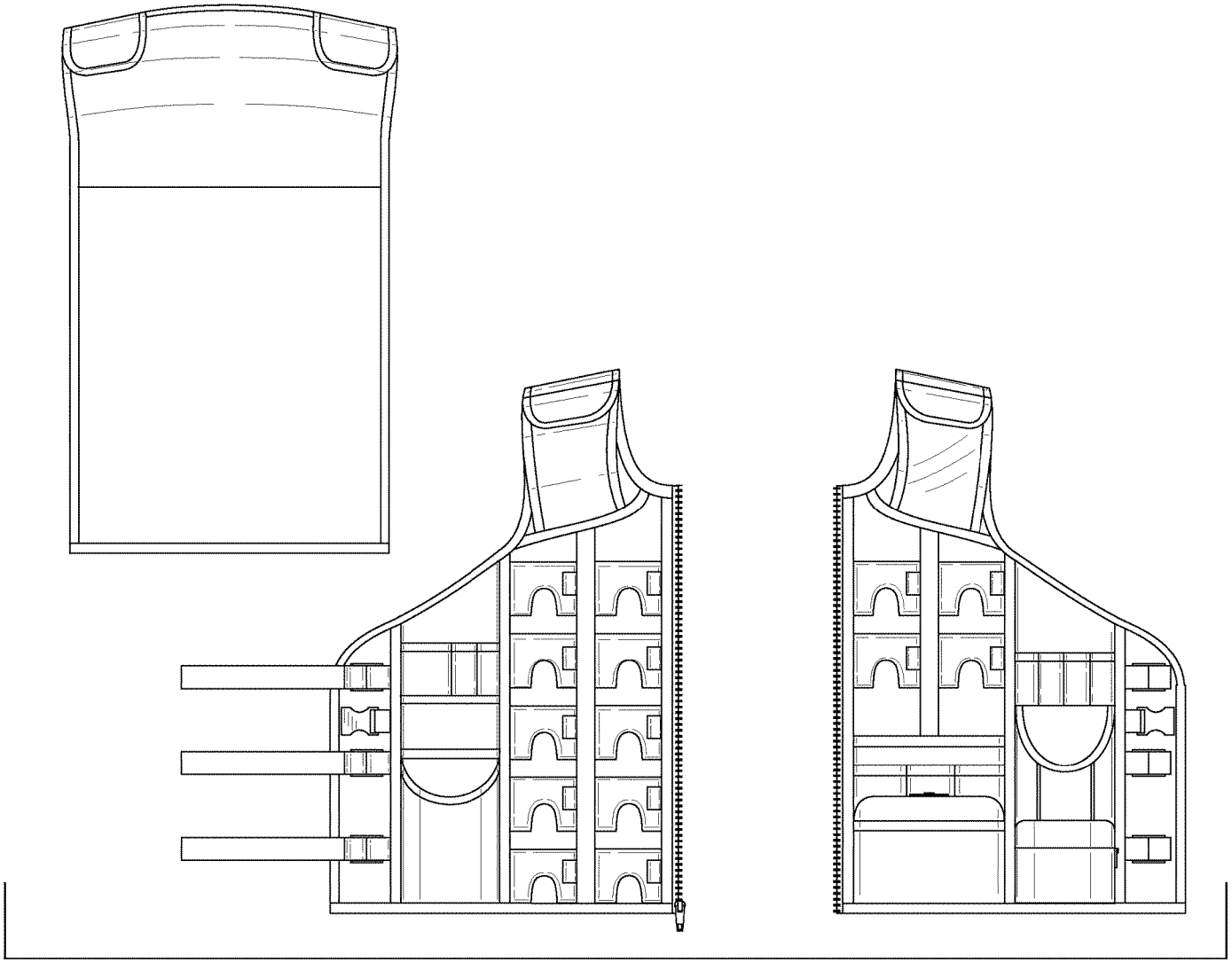
Figure 8:
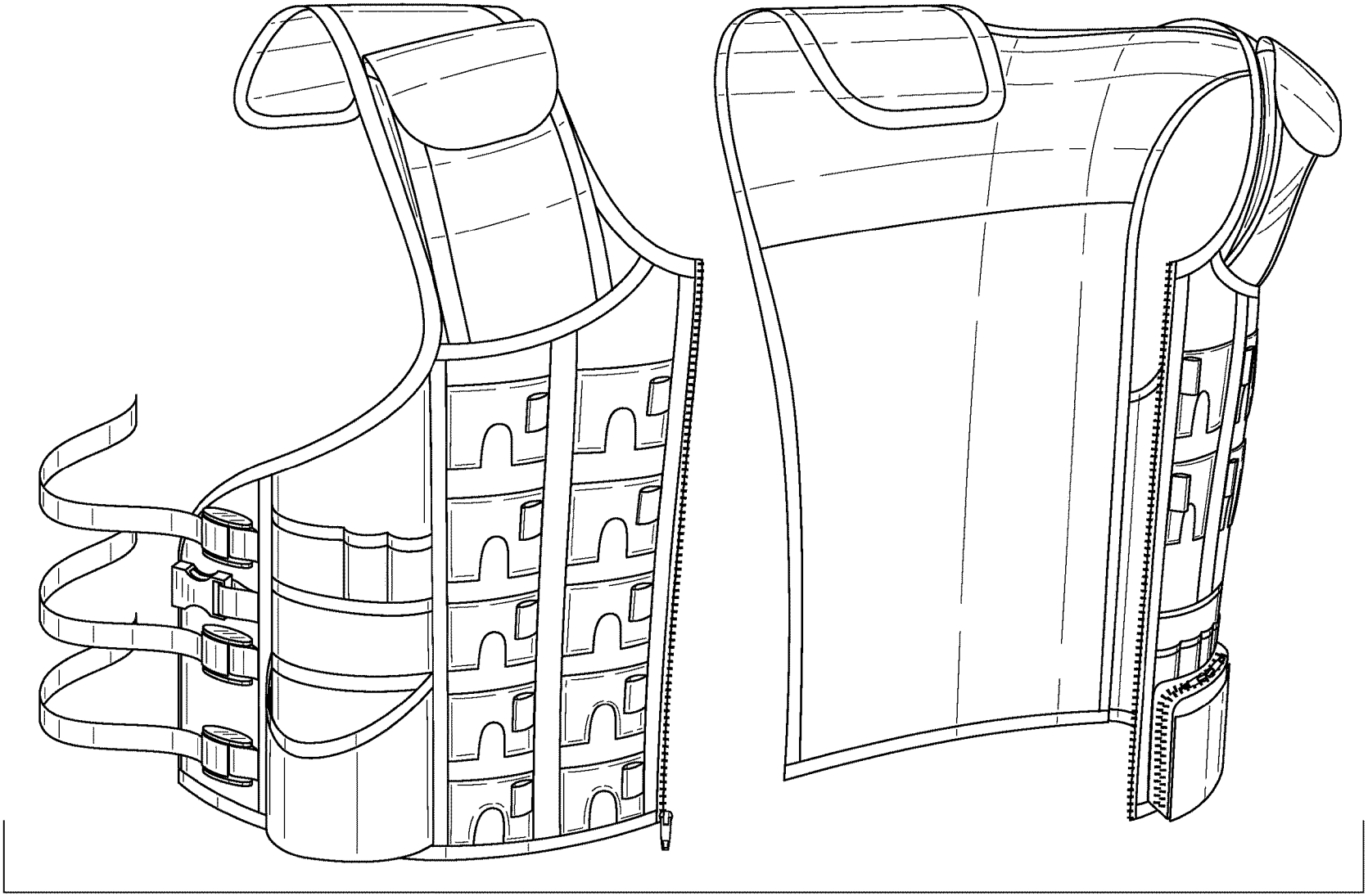
Figure 9:
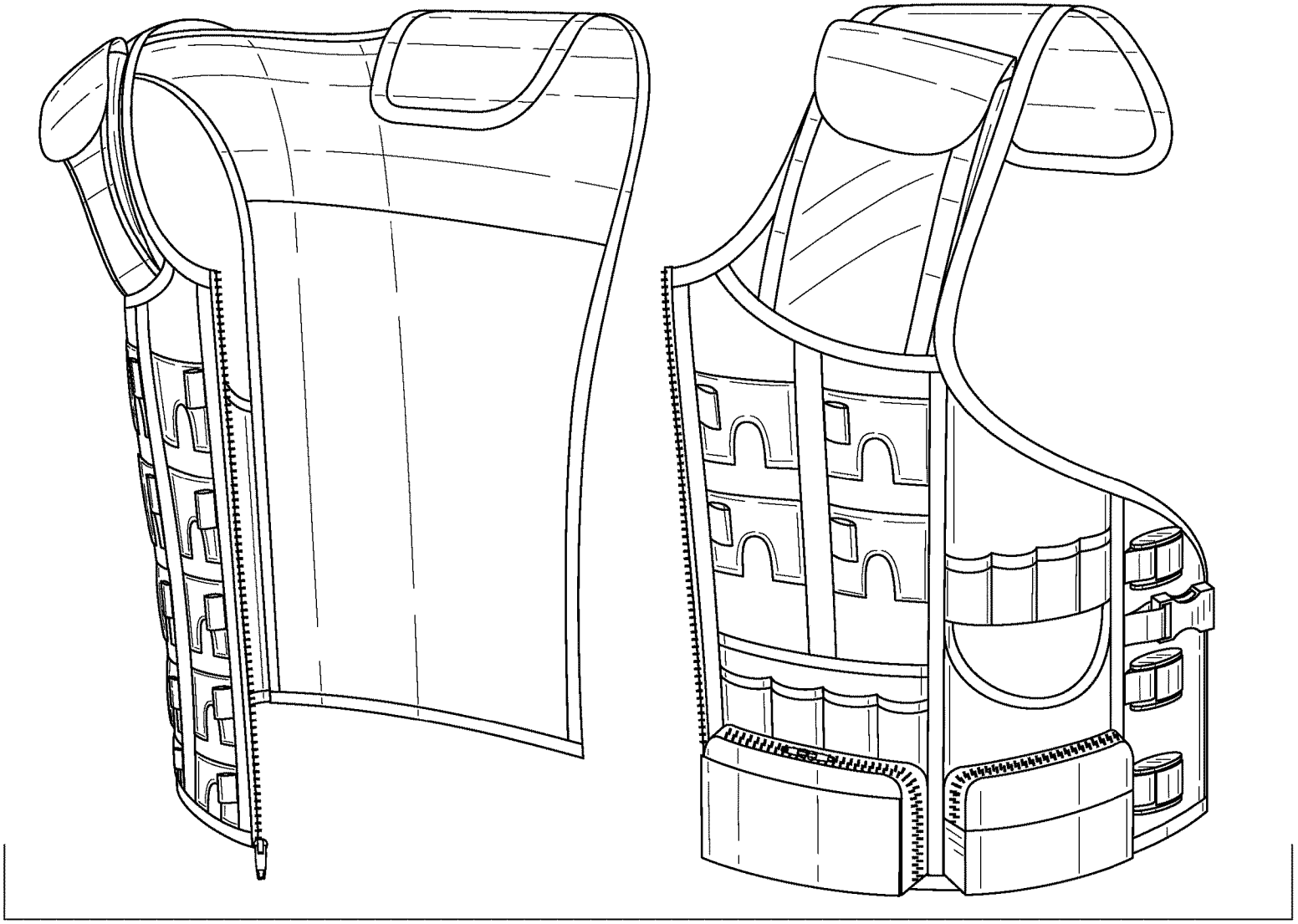
Figure 10:
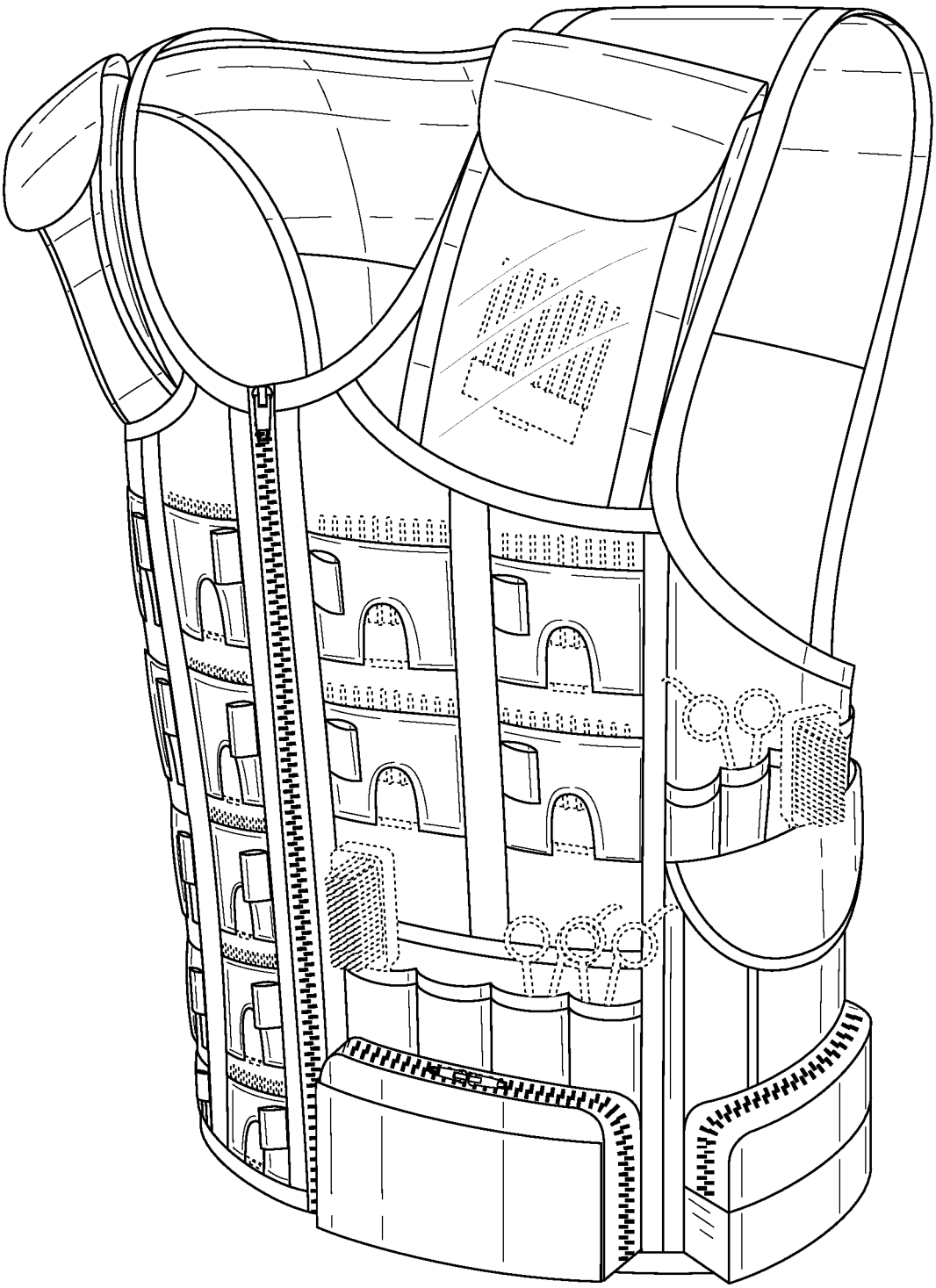
Figure 11:
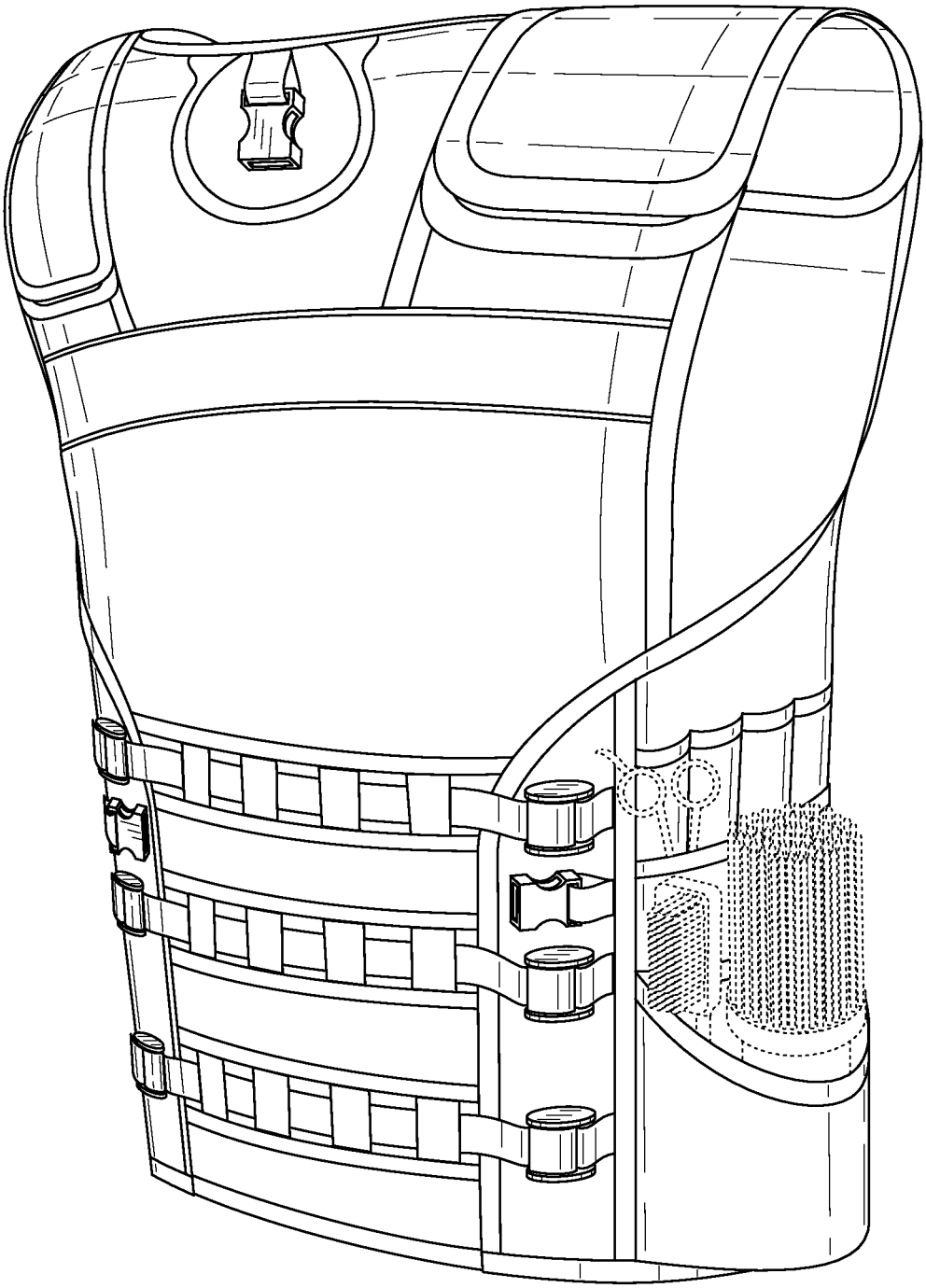

FIG. is a first side elevation view of FIG. 1 thereof;

FIG. 5 is a second side elevation view of FIG. 1 thereof;

FIG. 6 is a top plan view of FIG. 1 thereof;

FIG. 7 is an elevation view of FIG. 1 thereof, showing the panels of the garment disassembled;

FIG. 8 is a perspective view of FIG. 7 thereof:

FIG. 9 is another perspective view of FIG. 7 thereof;

FIG. 10 is another perspective view of FIG. 1 thereof, showing the garment in use with hair cutting tools, implements, and accessories; and FIG. 11 is another perspective view of FIG. 10 thereof.

The broken lines of the blades, guards, and other implements and accessories are for illustrative purposes only, and do not form part of the claimed design.

DETAILED DESCRIPTION OF THE INVENTION

The present invention, preferred embodiments of the invention, and the accompanying drawing figures as described herein should not be construed as limited to the illustrated drawing. Rather the illustrated embodiment(s) are detailed to provide a thorough disclosure suitable to convey the scope of the invention to those skilled in the art. For the sake of simplicity, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

Referring more particularly to the drawing by characters of reference, FIG. 1 depicts the garment management apparatus as a garment comprising (including or having) an assembly of retaining members for retaining a variety of implements, and a means for adjusting the fit of the garment on the user. The garment may further include an attachment assembly for removably attaching and coupling the garment to a backpack or other compartment for additional storage. The garment may be with or without sleeves for covering the user's arms. The garment has a front or front panel, two sides or side panels, and a back or back panel, with the garment further defining two arm openings, a neck opening, and a body opening. The garment may either be slipped over or otherwise be pulled over the user's head. Alternatively, the front of the garment may be further divided into at least two front panels so that the front panels may be opened and closed with a fastener. Preferably, the garment may be made from a lightweight, breathable material. The back of the garment may be made from a mesh or mesh-like material to allow air circulation throughout the garment.

The different fasteners used with the garment may be one or more of any combination of zippers, buckles, closures or clasps, buttons, snap members, D-ring members, hook and loop members, hook and eye members, hook and clip members, or adhesive members. The implements may include, but are not limited to, a plurality of attachment guide combs or clipper guards (collectively, "guards") each guard varying in size, a plurality of cutting or clipper blades each blade varying in size, scissors or shears, styling combs, brushes, towels, and mirrors. One or more of these implements may be used during the course of the haircut. It is useful to have each of these implements readily and easily accessible and identifiable when performing the haircut, rather than having the barber return to a separate station to retrieve these items.

In a preferred embodiment as shown in the figures, the garment is a vest 1. The vest 1 has two front panels fastenable together with a zipper. As shown in FIGS. 3-5 and 11, the back of the vest 1 has a back panel and a plurality of horizontal brace members 16 for structural support. A brace member 16 may be located at the upper portion of the back near the shoulder blades. A plurality of spaced apart brace members 16, preferably three brace members 16, may be located at the lower portion of the back. The vest may further include a pair of adjustable shoulder support members 11. As shown in FIG. 11, each side panel of the vest overlaps the back panel of the vest so that the side panels can be adjusted for a customized fit to the barber around the waist and under the arms.

The retaining members are each positioned or otherwise placed on or to the garment. At least one of the retaining members has a different size and shape from the other retaining members to accommodate the different sizes and shapes of the various implements stored or otherwise retained inside the retaining members. The assembly of retaining members may include one or more of any combination of sleeve members 2, 3, pouches 6, pockets 9, slot members 7, holders 8, or other retainers. Each of the retaining members is affixed to or at the garment or it is stacked or layered over and affixed to another retaining member. In an embodiment shown in FIG. 1, one or more of the retaining members may be positioned on or over another retaining member, for example, a pouch, pocket, or holder may be positioned or layered over one or more slot members. This layering provides for compact storage and efficiency. The retaining members may be attached to the garment or to another retaining member by sewing, gluing, taping, or by using hook and loop members. Sewing is preferred.

Each of the plurality of sleeve members 2, 3 has a front, a tab 4, and a cutout S defined in the front of the sleeve member 2, 3. In a preferred embodiment, the front of the sleeve member 2, 3 is affixed to the garment 1 by stitching the lateral sides and bottom end portions of the sleeve member 2, 3 to the garment 1. The upper portion of the front of the sleeve member 2, 3 remains open and outwardly expandable to receive the guard or cutting blade. The cutout S may be in any configuration or shape, but a substantially inverted U-shaped cutout is preferred. In an embodiment, the length of the cutout is at least half the length of the sleeve member, and is preferably, approximately over half the length of the sleeve member.

Each of the plurality of sleeve members 2, 3 is sized to receive one of a plurality of attachment guide combs or guards, or one of a plurality of cutting blades. Each of the guards or combs has a size corresponding to the respective sleeve member. The guard or blade is slidably inserted into the sleeve member 2, 3 and held into place by the resistance of the front of the sleeve member against the guard or blade. The snug fit of the guard or blade inside the sleeve member prevents the guard or blade from inadvertently falling out when the user bends over or otherwise inverts the garment. The sleeve member may further include a depressible member or material to further secure the implement inside the sleeve member. Each of the sleeve members 2, 3 has a size corresponding to the 0, 1, and 2 sizes for conventional guards or combs. Some of the sleeve members have a width of approximately 1.25 inches for receiving a guard that is approximately 1 inch wide. In an embodiment, each of the sleeve members has an approximate ½ inch opening between the front of the sleeve member and the garment, and an approximate ⅛ inch by ¾ inch foam bumper or other depressible material located on the garment inside the sleeve members. This foam bumper slightly pushes inwardly when pressure of the guard or blade is applied to the foam bumper.

To remove the guard or blade, upward pressure is applied to the lower part of the guard or blade at the sleeve member cutout as the guard or blade is upwardly and slidably pressed against the depression (not shown) inside the sleeve member. In a preferred embodiment, the bottom of cutout is open to allow the guard or blade to be slidably inserted through the sleeve member, with the guard or blade resting against the bottom seam of the sleeve member.

Most existing attachment guards for electric hair clippers have some kind of indicia to identify the different guard sizes to be selected for the desired cut length or for blending the hair. The required attachment guards for the different product brands of hair cutting devices may slightly vary in size and shape; however, most guards have dimensions within a certain size range expectation for which the sleeve members can accommodate. The length of the sleeve member is a little longer than the length average attachment guard for that particular sleeve member size.

The tab 4 may extend from the front of the sleeve member 2, 3. Alternatively, the tab 4 may be connected at or near the joining of the side of the sleeve member 2, 3 and the garment 1. The tab 4 may further include indicia (not shown) to identify the different sizes of the guards or blades. The indicia may include, either alone or in combination, a numbered system, an alphabetized system, a chart system, a colored system, a tactile system, or any other identifying system. The indicia may be arranged in a systematic order. The indicia may be permanently imbedded or affixed to each tab, removably placed on the tab, or positioned on the front of the flap or along the opening of the sleeve member. The indicia positioned on the tab is preferred.

The plurality of sleeve members 2, 3 may be arranged in a plurality of columns and rows along the front of the garment. In a preferred embodiment shown in the figures, the first set of sleeve members 2 retaining the removable guards are arranged in at least two columns and in at least five rows along one area of the front of the garment, and the second set of sleeve members 3 retaining the removable blades are arranged in at least two columns and in at least two rows on a different location on the front of the garment. The sleeve members 2, 3 are spaced apart to allow the user room to easily insert and remove the implements. The amount of spacing between the sleeve members may vary on the garment, depending on the size of the sleeve member and the respective guard or blade. In a preferred embodiment shown in FIG. 1, ten sleeve members are positioned on the garment to receive ten respective guards.

The pouch 6 preferably has a fastener 17 to secure items inside the pouch 6. For example, the barber can store money and other loose items inside the pouch. The pouch fastener is preferably a zipper. In a preferred embodiment as shown in FIGS. 1, 9-10, the pouch 6 may be positioned on, layered over, or otherwise incorporated into a row of a plurality of slot members 7. The front 18 exterior of the pouch 6 may further include an area for wiping off or cleaning a razor blade. Here, this area on the pouch may be a textured surface 18 (not shown). The surface may also include a wipe cloth. The surface 18 may be removably attachable to the front of the pouch 6, preferably with hook and loop members (not shown). Once removed, the surface itself can be washed. As shown in the figures, more than one pouch may be utilized with the garment. At least two pouches are preferred.

The slot members 7 are essentially elongated utility-style open slot members for holding objects, for example, scissors, styling combs, or writing instruments. The slot members 7 have lateral sides that may be joined to the garment to form a row of gusseted slot members, as shown in FIGS. 1-2, 4-5, and 7-1. The slot members may vary in size.

Each of the two pockets 9 may be positioned near the upper part of the front of the garment 1. Preferably, the pocket 9 has a closeable flap 10. At least one of the front of the pockets has a see-through material to view the pocket's contents. The pockets should be large enough to hold an electronic device, such as a phone, as illustrated in FIG. 11. In one embodiment, the pocket that retains the electronic device has dimensions of approximately 3.5 inches by 6 inches. Another pocket 9 may be positioned on the side panel of the garment 1. This side pocket 9 may be layered or positioned over a row of slot members 7, a pouch 6, or any combination of these retaining members. The side pocket 9 may be enclosed with a flap 10 or a zipper. In another embodiment, the front of each of the pockets may further define a cutout (not shown) similar to the cutout on the sleeve members. The pocket cutout facilitates removal of the pocket contents.

The holder 8 may be positioned at one of the sides of the garment, as shown in FIG. 1. The holder 1 may be layered over the slot members 7, a pouch 6, or both. In one embodiment, at least one of the retaining members, namely, a pouch or a pocket, further includes an insulated interior. The garment may further have a spool member (not shown) with a retainer ring or clip for supporting a handheld mirror. A key holder may also be provided on the garment.

In another embodiment, the garment may further include one or more loops for holding a spray bottle, scissors, and other implements, with at least one loop located on or near each lower portion of the side panel of the garment (not shown). The loop may be positioned away from the garment, rather than remaining flat against the garment, to easily hang or support the spray bottle. One of the loops is located approximately 3 inches from the bottom of the garment. The loops may be made from an elastic material. Hooks on the garment may also be used on the back panel near the barber's hip area, for example, to hold a mirror or a towel.

The means for adjusting the fit of the garment includes two adjustable shoulder support members 11 and at least one adjustable side strap member 12. In an embodiment shown in FIG. 3, each shoulder support member 11 essentially extends upwardly from the front of the garment 1 to drape over the upper back portion of the garment 1, with the support member 11 having a bottom textured surface or hook and loop members (not shown) that is mateable with the upper back portion of the garment 1. Each support member may be raised or lowered along the upper back portion of the garment for a customized fit, then secured with the hook and loop members. Alternatively, the support members may use a clip fastener to removably secure the support member to the back of the garment. The adjustable support member accommodates shoulder height and chest span of the user.

As shown in FIGS. 3-5, 7-9, and 11, the side strap assembly includes a plurality of strap members 12, with each end of the strap members 12 coupled to a fastener 19. Preferably, buckles, and more particularly, snap buckles or side-release buckles are used. In the embodiment shown in the figures, three side strap members 12 are used for selectively customizing the fit of the garment 1 about the lower and middle waist area and underneath the armpit area of the user. The band 13 may be supported by one or more loops 14 connected to the back of the garment 1, with the loops 14 having a channel for which the band 13 is inserted therethrough.

The attachment assembly 15 allows the barber to removably attach or connect a backpack (not shown) at or to the garment 1 for additional storage. The backpack may be any satchel, backpack, carrying case, compartment or container that has an internal storage capacity. In a preferred embodiment as shown in FIGS. 3-5 and 11, the attachment assembly utilizes three attachment members 15 that are employed preferably at the back of the garment. The attachment members 15 are essentially fasteners, namely, buckles or clasps. Using snap buckles or side-release buckles is preferred. A first mating end of each of the buckles is affixed or otherwise secured to the rear sides and to the upper rear neck portion of the garment with the corresponding second mating end of each of the buckles is affixed to or is temporarily attached to the backpack. Using the attachment assembly also allows the user to disregard the backpack's conventional arm straps when transporting the backpack.

When a barber wears the garment, and preferably when the garment is a vest, he can easily and efficiently access, retrieve, and store various implements without needing to leave the subject. Placement of the retaining members provides a novel and nonobvious flow of movement for conducting a haircut. While cutting the hair, the barber can easily remove the implements from the retaining members due to the consistent location and tactile arrangement of the retaining members.

Those skilled in the art who have the benefit of this disclosure will appreciate that it may be used as the creative basis for designing apparatus, devices or methods similar to those disclosed herein, or to design improvements to the invention disclosed herein; such new or improved creations should be recognized as dependent upon the invention disclosed herein, to the extent of such reliance upon this disclosure.

I claim:

1. A barber management garment for selectively managing, storing, and accessing a plurality of hair cutting attachment guards, a plurality of hair cutting blades, a plurality of hair styling and cutting implements, and a plurality of accessories used during cutting or styling hair, the barber management garment comprising:

a) a front and two side panels, with the front of the garment comprising a first front panel, a second front panel, and a fastener, with the first front panel and the second front panel being selectively closable with the fastener;

b) a plurality of sleeve members, i) with each of the plurality of sleeve members being attached to the front of the barber management garment;

ii) with each of the plurality of sleeve members having a front portion, a top portion, a bottom portion, a tab, and a single inverted U-shaped cutout centered and defined in the front portion of the sleeve member at the bottom portion, with the inverted U-shaped cutout removably holding either one of the plurality of hair cutting blades or one of the plurality of hair cutting attachment guards inside the sleeve member with resistance against the sleeve member to prevent inadvertent removal of the hair cutting blade or hair cutting attachment guard, and with a length of the inverted U-shaped cutout being at least one-half a length of the sleeve member measured from the top portion to the bottom portion; and iii) with a first set of the plurality of sleeve members being arranged in at least two columns and at least five rows on a first section of the front of barber management garment, and a second set of the plurality of sleeve members being at least two columns and at least two rows on a second section of the front of the barber management garment;

iv) wherein each of the plurality of sleeve members has a size adapted for slidably receiving either one of the plurality of hair cutting attachment guards or one of the plurality of hair cutting blades to prevent inadvertent removal of either the hair cutting attachment guard or the hair cutting blade, with one of each of the plurality of hair cutting attachment guards or the plurality of hair cutting blades adapted to be slidably removable from a respective sleeve member of the plurality of sleeve members by applying upward pressure to the hair cutting attachment guard or hair cutting blade through the inverted U-shaped cutout;

c) a plurality of retaining members, i) each of the plurality of retaining members being positioned on or to the barber management garment with at least one of the plurality of retaining members having a different size and shape from the remaining plurality of retaining members;

ii) the plurality of retaining members comprising at least two pouches with each of the at least two pouches having a fastener for opening and closing each of the at least two pouches; at least one open holder; a plurality of open slot members; and at least two pockets with each of the at least two pockets having a closable flap and with each of the at least two pockets being positioned on or to an upper portion of the front of the barber management garment, with at least one of the plurality of retaining members being layered over or positioned over at least another one of the plurality of retaining members; and d) two adjustable side strap members, each having a band and a pair of opposing connectable fasteners for tightening or loosening a fit of the barber management garment, and two adjustable shoulder support members, each having a flap member adjustable to tighten or loosen the fit of the barber management garment around a user's shoulders and chest.

2. The garment of claim 1, the at least one open holder of the plurality of retaining members further is larger than the plurality of open slot members.

3. The garment of claim 1, the garment further comprising a depressible member behind or within each of the plurality of sleeve members.

4. The garment of claim 1, the garment further comprising an attachment assembly for removably coupling the garment to a backpack.

5. The garment of claim 1, the tab of each of the plurality of sleeve members comprising indicia for identifying a corresponding size of the plurality of hair cutting attachment guards or the plurality of hair cutting blades that may be placed within each of the plurality of sleeve members.

6. A barber management vest for selectively managing, storing, and accessing a plurality of hair cutting attachment guards, a plurality of hair cutting blades, a plurality of hair styling and cutting implements, and a plurality of accessories used during cutting or styling hair, the barber management vest comprising:

a) a front with a first front panel and a second front panel, two side panels, and a fastener, with the first front panel and the second front panel being selectively closable with the fastener;

b) a plurality of sleeve members, i) with each of the plurality of sleeve members being attached to the front of the barber management vest;

ii) with each of the plurality of sleeve members having a front portion, a top portion, a bottom portion, a tab, and a single inverted U-shaped cutout centered and defined in the front portion of the sleeve member at the bottom portion, a tab, and a single inverted U-shaped cutout centered and defined in the front portin of the sleeve member at the bottom portion, with the inverted U-shaped cutout removably holding either one of the plurality of hair cutting blades or one of the plurality of hair cutting attachment guards inside the sleeve member with resistance against the sleeve member to prevent inadvertent removal of the hair cutting blade or hair cutting attachment guard, with a length of the inverted U-shaped cutout being at least half the length of the bottom portion of the sleeve member measured from the top portion to the bottom portion;

iii) wherein a first set of the plurality of sleeve members is arranged in at least two columns and at least five rows on the first front panel of the barber management vest, and a second set of the plurality of sleeve members is arranged in at least two columns and at least two rows on the second front panel of the barber management vest; and iv) wherein each of the plurality of sleeve members having a size adapted for slidably receiving either one of the plurality of hair cutting attachment guards or one of the plurality of hair cutting blades to prevent inadvertent removal of either the hair cutting attachment guard or the hair cutting blade, with one of each of the plurality of hair cutting attachment guards or the plurality of hair cutting blades adapted to be slidably removable from a respective sleeve member of the plurality of sleeve members by applying upward pressure to the hair cutting attachment guard or hair cutting blade through the inverted U-shaped cutout;

c) a plurality of retaining members, i) with each of the plurality of retaining members being attached to the barber management vest;

ii) with at least one of the plurality of retaining members having a different size and shape from the remaining plurality of retaining members;

iii) with the plurality of retaining members comprising at least two pouches with each of the at least two pouches having a fastener for opening and closing each of the at least two pouches; at least one open holder; at least three pockets with a first of the at least three pockets being attached to an upper portion of the first front panel of the barber management vest, and a second of the at least three pockets being attached to an upper portion of the second front panel of the barber management vest; and a plurality of open slot members; with at least one of the at least two pouches, or the at least one open holder, or the at least three pockets being layered over or positioned over a set of the plurality of the open slot members;

d) two adjustable side strap members, each having a band and a pair of opposing connectable fasteners for tightening or loosening a fit of the vest, and two adjustable shoulder support members, each having a flap member adjustable to tighten or loosen the fit of the vest around a user's shoulders and chest; and e) an attachment assembly having a plurality of attachment members for releasably coupling the vest to a backpack.

7. The barber management vest of claim 6, the plurality of sleeve members further comprising at least one of the plurality of sleeve members having a different size from the remaining plurality of sleeve members.

8. The barber management vest of claim 6, the garment further comprising a depressible member behind or within each of the plurality of sleeve members.

9. The barber management vest of claim 6, the tab of each the plurality of sleeve members comprising indicia for identifying a corresponding size of each of the plurality of hair cutting attachment guards or the plurality of hair cutting blades that may be placed within each of the plurality of sleeve members.

* * * * *